United States Patent [19]

Jackson

[11] 4,193,334

[45] Mar. 18, 1980

[54] GUN SIGHT POSITIONING MECHANISM

[75] Inventor: Theodore A. Jackson, Utica, Mich.

[73] Assignee: Cadillac Gage Company, Utica, Mich.

[21] Appl. No.: 929,393

[22] Filed: Jul. 31, 1978

[51] Int. Cl.[2] ..... F41G 1/40

[52] U.S. Cl. ..... 89/41 E; 33/237; 350/26; 350/302; 356/7; 356/254

[58] Field of Search ..... 33/235, 237; 89/41 E; 350/10, 21, 22, 24, 25, 26, 48, 49, 52, 301, 302; 356/7, 254, 255

[56] References Cited

U.S. PATENT DOCUMENTS

| | | | |
|---|---|---|---|
| 2,360,850 | 10/1944 | Colby | 89/41 E |
| 2,369,806 | 2/1945 | Slonneger | 33/235 |
| 2,390,516 | 12/1945 | Crawford | 89/41 E |
| 2,466,725 | 4/1949 | Minter | 89/41 E |
| 3,263,567 | 8/1966 | Sandahl | 89/41 E |
| 3,309,962 | 3/1967 | Lykam | 89/41 E |
| 3,355,987 | 12/1967 | Kunze | 350/302 |
| 3,424,052 | 1/1969 | Ruf | 350/302 |
| 3,493,296 | 2/1970 | Albert | 350/302 |
| 3,545,837 | 12/1970 | Chapman | 89/41 E |
| 3,782,802 | 1/1974 | Hohl et al. | 350/301 |
| 3,868,169 | 2/1975 | Pfenninger et al. | 350/301 |

*Primary Examiner*—Stephen C. Bentley

*Attorney, Agent, or Firm*—Reising, Ethington, Barnard, Perry & Brooks

[57] ABSTRACT

A gun sight positioning mechanism (22) disclosed includes a parallelogram linkage for moving a gun sight positioning shaft angularly with a trunnion shaft (32) on which a gun is supported and has a slip clutch (44) that connects the linkage to one of the shafts so that the sight can be aimed downwardly at the target area while the gun remains aimed upwardly along the projectile path. Preferably, the slip clutch connects the linkage to the gun sight positioning shaft and includes a stop (56) that allows the sight to be aimed upwardly back into alignment with the gun after viewing the impact. First and second links (46,52) of the linkage are respectively connected to the trunnion and sight positioning shafts and interconnected by a connecting link (54) whose length is adjustable to insure the proper angular movement of each shaft with the other. A mount of the slip clutch has a flanged end secured to the sight positioning shaft and a distal end on which a handle (58) is secured to provide the pivoting of the sight shaft independently of the gun. A spring washer of the clutch biases a brake member thereof against the second link which is thereby engaged with the flanged end of the mount to provide the slip clutch action.

16 Claims, 5 Drawing Figures

GUN SIGHT POSITIONING MECHANISM

TECHNICAL FIELD

This invention relates to a positioning mechanism for moving a gun sight angularly in a tracking relationship with an associated gun.

BACKGROUND ART

It is conventional to connect a gun sight to an associated gun for angular movement therewith in a tracking relationship. Quite often parallelogram linkages are utilized since the parallel and equal length relationship of the opposite sides of the linkage provides the required equal angular movement of the gun sight with the gun. See, for example, U.S. Pat. No. 2,390,516.

Couplings for angularly adjusting or disconnecting a gun sight from an associated gun have also been used in the past. U.S. Pat. No. 2,360,850 discloses a coupling which includes an eccentric for angularly aligning a gun sight with an associated gun whereupon a bolt of the coupling is tightened to secure the gun sight in the aligned condition with the gun. Likewise, U.S. Pat. Nos. 2,466,725; 3,263,567; and 3,424,052 disclose gun sight positioning mechanisms having manually actuated couplings for uncoupling the gun sight from the associated gun. Such uncoupling allows the gun sight to be aimed to view the terrain in a direction toward which the gun mount does not allow the gun to be aimed. Also, U.S. Pat. Nos. 2,369,806; 3,545,837; and 3,782,808 disclose gun sight positioning mechanisms having solenoid actuated couplings for connecting or disconnecting gun sights from their associated guns.

Other gun sight positioning mechanisms and the like are disclosed by U.S. Pat. Nos. 3,309,962; 3,355,987; 3,493,296; and 3,868,169.

Usually the field of vision of a gun sight includes a reticle having a verticle line and vertically spaced dots or cross hairs spaced along the vertical line. Aiming of the gun is accomplished by first aligning the vertical line of the reticle with the target and then moving the sight and the gun to an inclined position that will give the required projectile distance to the target. Initially the distance may have to be estimated and a round fired to determine whether the inclination corresponds to the required projectile length. For relatively short target distances, the cross lines or dots of the reticle can be aligned with the target and the impact can be viewed through the sight field of vision to determine whether a greater or lesser projectile length is necessary. However, for longer target distances, the gun and sight must be inclined at an angle that is great enough so that the target is located below the area encompassed by the sight field of vision. In such instances, the gunner must view the impact without the aid of the sight in order to determine whether the proper projectile distance to the target is present and adjust accordingly. Of course, both the sight and the gun could be moved downwardly so that the impact could be viewed through the sight but the angularly adjusted position of the gun would then have to be reset upon upward movement after the impact is viewed.

DISCLOSURE OF INVENTION

An object of the present invention is to provide an improved gun sight positioning mechanism that normally moves the gun sight in a tracking relationship with an associated gun and incorporates a slip clutch that allows the gun sight to be pivoted downwardly independently of the gun to view an impact and to be subsequently moved back into an aligned relationship with the gun.

In carrying out the above object and other objects of the invention, the positioning mechanism includes a parallelogram linkage that connects a gun sight positioning shaft for angular movement with a gun trunnion shaft such that the gun sight tracks with a gun supported on the trunnion shaft. The slip clutch of the mechanism connects the linkage to one of the shafts so as to allow the sight positioning shaft to pivot the sight downwardly independently of the gun so that the impact can be viewed.

In the preferred construction, the slip clutch is disposed between the linkage and the positioning shaft of the gun sight. Movement of the sight positioning shaft back into alignment with the gun is facilitated by a stop of the slip clutch so that the operator does not have to perform any involved manipulation in order to align the sight with the gun.

The preferred construction of the linkage includes a first link having a connection to the gun trunnion shaft and a second link whose connection to the gun sight positioning shaft is provided by the slip clutch. A connecting link extends between the first and second links in a parallel relationship to a line between the pivotal axes of the shafts. Adjustment of the connecting link length so as to be equal to the spacing between the shaft axes provides the angular tracking of the sight with the gun.

The slip clutch preferably includes a mount having a flanged end secured to the positioning shaft of the gun sight and a distal end to which a handle is secured to move the positioning shaft independently of the linkage while the slip clutch action takes place. Engagement of a brake member with the second link provides a biasing thereof against the flanged end of the mount under the action of a spring washer on the mount. Threading of a nut onto the distal end of the mount against a retainer that biases the spring washer against the brake member with an interposed washer allows a control of the torque necessary to provide the slip clutch action. Engagement of the handle with the stop which is preferably located on the second link provides automatic realignment of the sight and the gun.

The connection of the first link to the gun trunnion shaft preferably includes an annular coupling member that receives the shaft and is fixed thereto for up and down pivoting with the gun. Threaded set screws are utilized to provide the fixed relationship of the coupling member to the trunnion shaft. A scale is also fixed on the coupling member and has distance indications located adjacent a fixed indicator member mounted to the gun sight such that the coupling member pivotally moves the scale with respect to the indicator member and thereby functions as an indicator that displays an approximate projectile firing distance for any given gun elevation angle.

The objects, features, and advantages of the present invention are readily apparent from the following description of the best mode for carrying out the invention when taken in connection with the accompanying drawings.

BEST MODE FOR CARRYING OUT THE INVENTION

Figure 1:
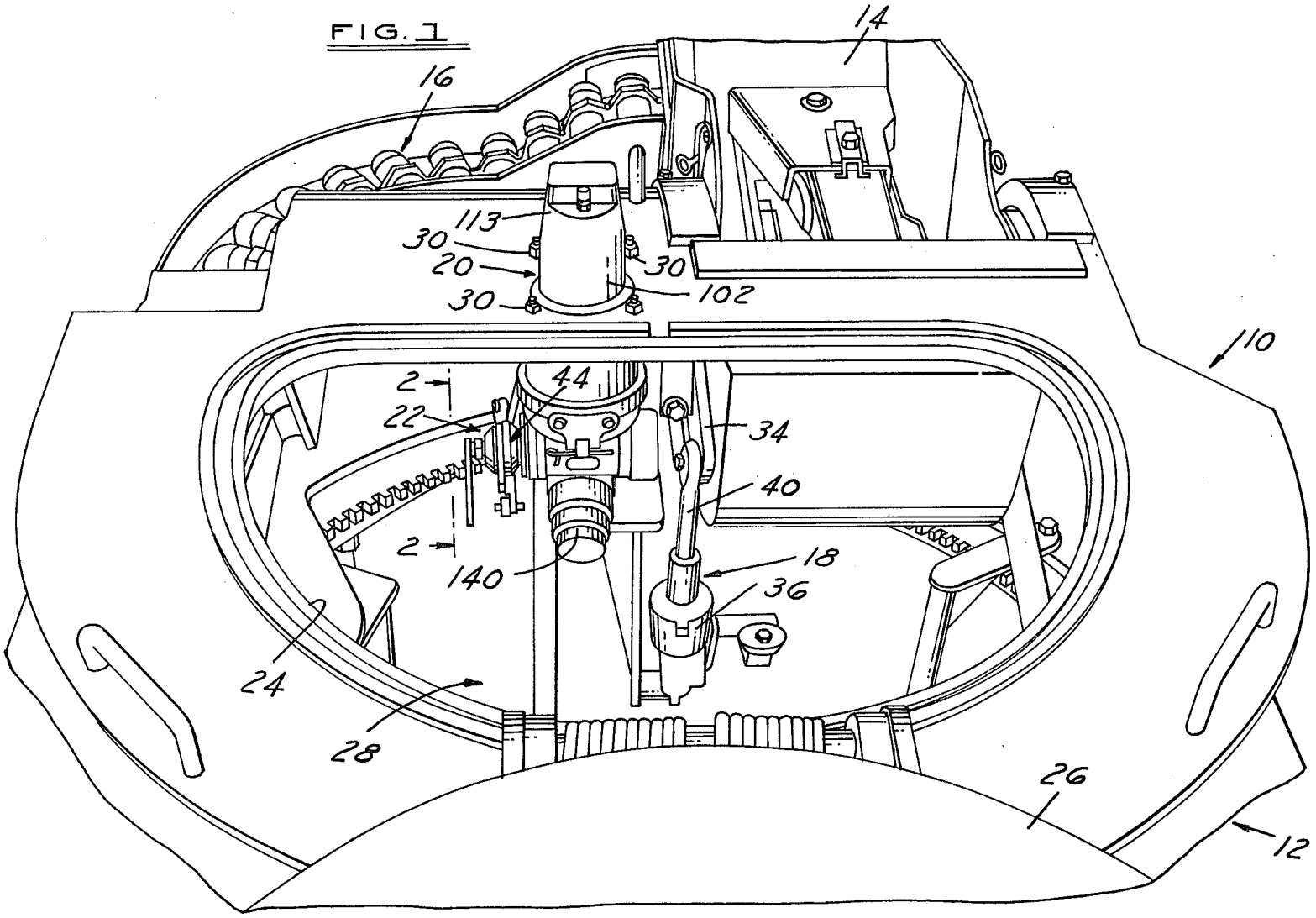
FIG. 1 is a perspective view of a gun turret that incorporates a gun sight positioning mechanism constructed according to the present invention.

Referring to FIG. 1 of the drawings, a gun turret indicated by 10 is rotatably supported about a vertical axis on an armored vehicle 12 and includes an automatic gun 14 which is fed by an ammunition belt 16 during firing. Upward and downward angular movement of the gun 14 to change the inclination of the projectile path is controlled by an angular positioner indicated by 18. A periscope-type gun sight 20 is coupled with the gun 14 by a positioning mechanism 22 which is constructed in accordance with the present invention. Gun turret 10 has an upper hatch 24 that is selectively closed by a cover 26 so that a gunner within the turret compartment 28 is protected while operating the gun 14. Gun sight 20 is secured to the turret 10 by nut and bolt connections 30 with its upper end projecting above the turret and its lower end recieved within the compartment 28 and connected with the positioning mechanism 22 in a manner that is more fully hereinafter described.

Figure 2:
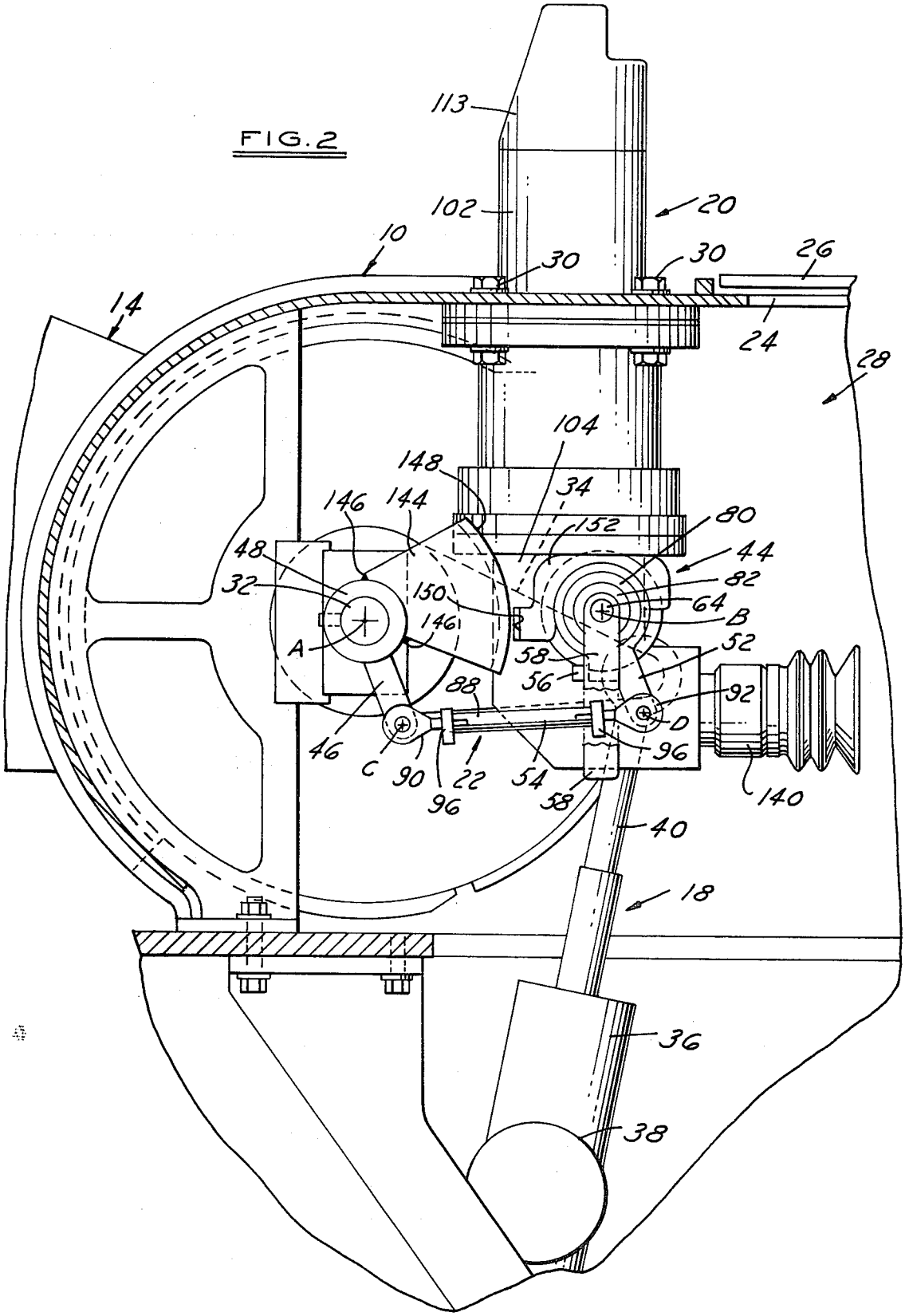
FIG. 2 is an elevation view taken partially in section along line 2—2 of FIG. 1 and illustrates a parallelogram linkage of the positioning mechanism.

As seen in FIG. 2, gun 14 is supported on the turret 10 for angular movement along the central axis A of a trunnion shaft 32 in order to control the angular inclination of projectiles fired by the gun. Link 34 has an inner end which is fixedly secured to the trunnion shaft 32 such that pivoting of the link 34 about axis A pivots the gun 14 thereabout through the connection provided by the trunnion shaft. Gun positioner 18 includes a control cylinder 36 that is pivotally supported by a bearing 38 and includes a piston connecting rod 40 whose distal end is secured to the outer end of link 34 by a pivotal connection. Control fluid selectively supplied to the cylinder 36 on opposite sides of a piston therein extends and retracts the rod 40 so as to thereby pivot the link 34 about axis A and control the vertical inclination of the gun 14. Extension of rod 40 pivots the link 34 and the trunnion shaft 32 counterclockwise so as to pivot the gun 14 downwardly, while rod retraction pivots the link and the trunnion shaft clockwise and thereby pivots the gun upwardly.

Figure 3:
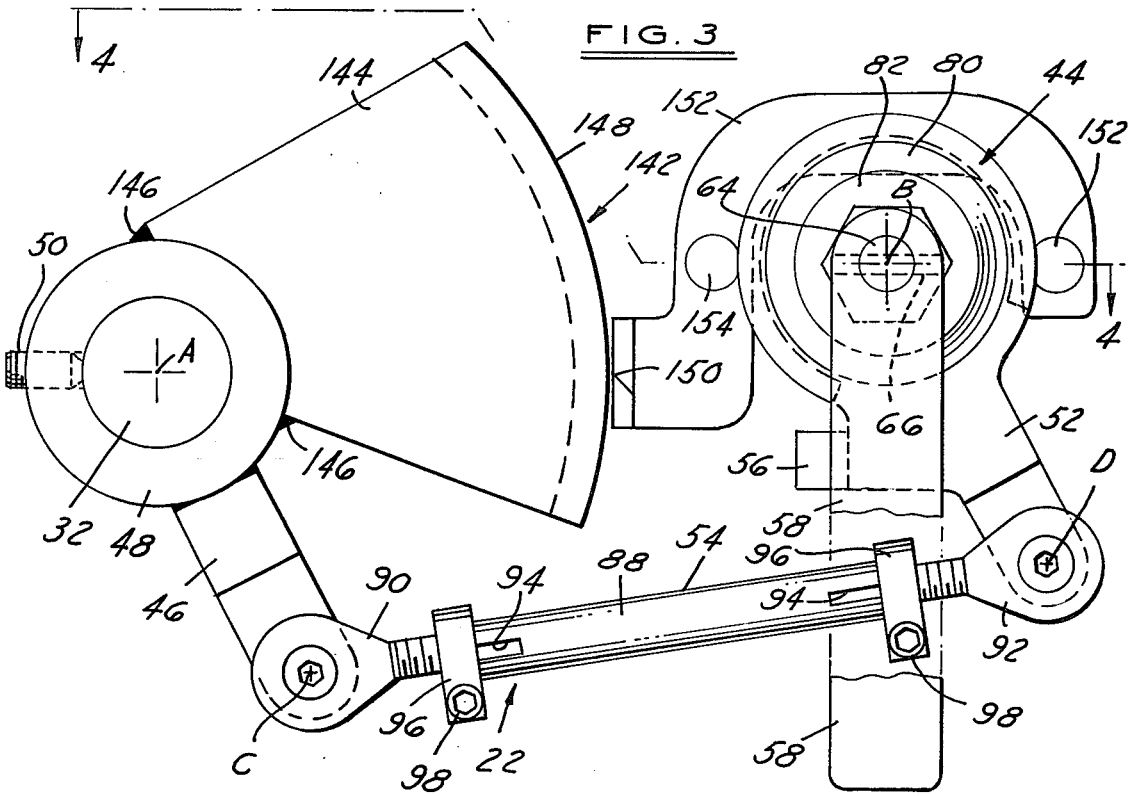
FIG. 3 is an enlarged view taken in the same direction as FIG. 2 and further illustrating the linkage of the positioning mechanism.
Figure 4:
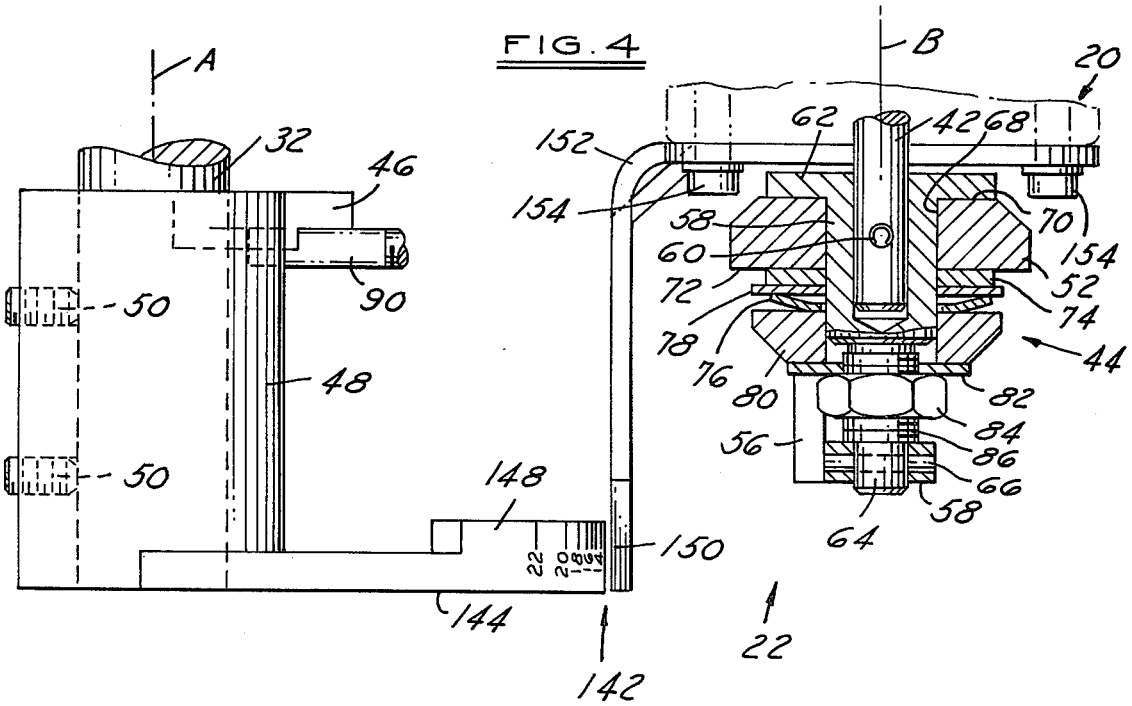
FIG. 4 is a plan view taken partially in section along line 4—4 of FIG. 3 and illustrates a slip clutch of the positioning mechanism that allows the gun sight to selectively be aimed independently of the gun.

With additional reference to FIGS. 3 and 4, the gun sight 20 includes a positioning shaft 42 (FIG. 4) that is pivotable about an axis B parallel to axis A in order to control the vertical inclination at which the gun sight is aimed. Positioning mechanism 22 includes a parallelogram linkage that extends between the gun trunnion shaft 32 at axis A and the gun sight positioning shaft 42 at axis B in order to move the positioning shaft of the gun sight angularly with the gun in a tracking relationship. Upward or downward pivoting of the gun along axis A for any angle of adjustment is thus accompanied by a concomitant angular rotation of the sight shaft 42 in order to maintain the gun sight aimed along the direction of the gun barrel. A slip clutch 44 (FIG. 4) of the mechanism connects the parallelogram linkage to the gun sight input shaft 42 to normally provide the angular pivoting thereof with the gun trunnion shaft 32 so that the gun sight tracks with the gun as previously described. For relatively long target distances, slipping action of clutch 44 allows the gun sight to be aimed downwardly at the target area to view the impact while the gun remains upwardly along the projectile path.

With reference to FIG. 3, the parallelogram linkage of positioning mechanism 22 includes a first link 46 whose inner end has a connection to the trunnion shaft 32 provided by an annular member 48 to which the link is fixedly secured in any suitable manner projecting outwardly in a radial direction with respect to the axis A. Trunnion shaft 32 is received within the annular member 48 and rotatably fixed with respect thereto by a pair of threaded set screws 50. A second link 52 of the linkage has a connection to the gun sight positioning shaft 42 along axis B provided by the slip clutch 44. Link 52 projects radially from the axis B in a parallel relationship to the link 46 that projects radially from axis A. Outer ends of links 46 and 52 are connected with each other by a connecting link 54 of the parallelogram linkage. Link 54 extends parallel to a line through axes A and B and has a length between pivotal connections at opposite ends thereof to links 46 and 52 which is equal to the spacing between the axes A and B. As such, angular rotation of the trunnion shaft 32 pivots the link 46 so that the link 54 is shifted to pivot link 52 through the same angle as the gun and thereby move the gun sight positioning shaft 42 about axis B so that the gun sight tracks with the gun.

Link 52, which is connected to the gun sight positioning shaft 42 by the slip clutch 44 shown in FIGS. 3 and 4, has a stop 56 (FIG. 3) which is engaged by an operating handle 58 of slip clutch 44 in order to facilitate realignment of the gun sight with the gun. For relatively long target distances where the gun sight field of vision does not encompass the target when aligned with the gun, handle 58 is pivoted counterclockwise along the axis B to aim the gun sight 20 downwardly independently of any gun movement and thereupon moves out of the engaged condition with the stop 56 as shown in FIG. 3. Impact of the fired projectile can thus be viewed through the gun sight even for long target distances. Subsequently, the handle 58 is pivoted clockwise back into engagement with the stop 56 so that the parallelogram linkage of the positioning mechanism 22 again aligns the gun sight with the gun. During both the clockwise and counterclockwise pivoting of the handle 58, the slip clutch 44 allows the independent movement of the gun sight positioning shaft 42 without any movement of the parallelogram linkage or the trunnion shaft 32 to which both the linkage and the gun are connected.

Slip clutch 44 is best shown in FIG. 4 and includes a tube-like mount 58 that receives the gun sight positioning shaft 42 and is rotatably fixed thereto by a pin 60. Mount 58 has one end which includes an annular flange 62 that extends radially from the axis B in a perpendicular relationship. Mount 58 also has a distal end 64 to which the handle 58 is rotatably fixed by a pin 66. The inner end of link 52 has a round opening 68 that recieves the mount 58 such that one side 70 of the inner link end is engaged with the mount flange 62. The other side 72 on the inner end of link 52 is engaged by an annular brake member 74 whose central opening also receives the mount. An annular washer spring 76 of a frustoconical shape has an outer periphery that is engaged with a washer 78 to bias the brake member 74 against the link 52 and thereby bias the link against the mount flange 62. A retainer 80 engages the inner periphery of the washer spring 76 and is positioned by a washer 82 and a nut 84 that is received by a threaded portion 86 of the distal mount end. The degree to which the nut 84 is threaded onto the mount portion 86 controls the extent of the washer spring bias which engages the link 52 with the mount flange 62. This bias must be great enough so that the link 52 normally pivots with the gun trunnion shaft 32 for tracking movement with the gun but must be small enough so that the handle 58 can be pivoted to move the gun sight positioning shaft 42 while slippage takes place between the link 52 and the mount 58 of the slip clutch.

Connecting link 54 of the parallelogram linkage is shown in FIG. 3 as including an intermediate link member 88 whose opposite ends receive threaded rod ends 90 and 92 which are pivotally connected to the links 46 and 52 along respective axes C and D. As previously mentioned, the radial length of link 46 between axes A and C is equal to the radial length of link 52 between axes B and D. Also, the length of the connecting link 54 between axes C and D must be equal to the spacing between axes A and B in order to provide the proper tracking movement of the gun sight. Link 54 can be adjusted by the threading of the rod ends 90 and 92 to the link member 88 in order to adjust the length of the link to provide the proper tracking relationship. Each end of the link has axial slots 94 (only one shown at each end) and an associated clamp 96 that secures the associated rod end after the length adjustment. Threaded screws 98 of the clamps 96 are loosened to allow the adjustment of the rod ends in a turn-buckle fashion as the link member 88 is rotated and the screws are subsequently tightened to clamp the rod ends at the slots 94 of the link member in order to fix the link length after the adjustment. Since the tightening of the clamps 96 is not in an axial direction as is the case with jam nuts, the adjusted length of the link remains the same before and after the clamping action by clamps 96.

Figure 5:
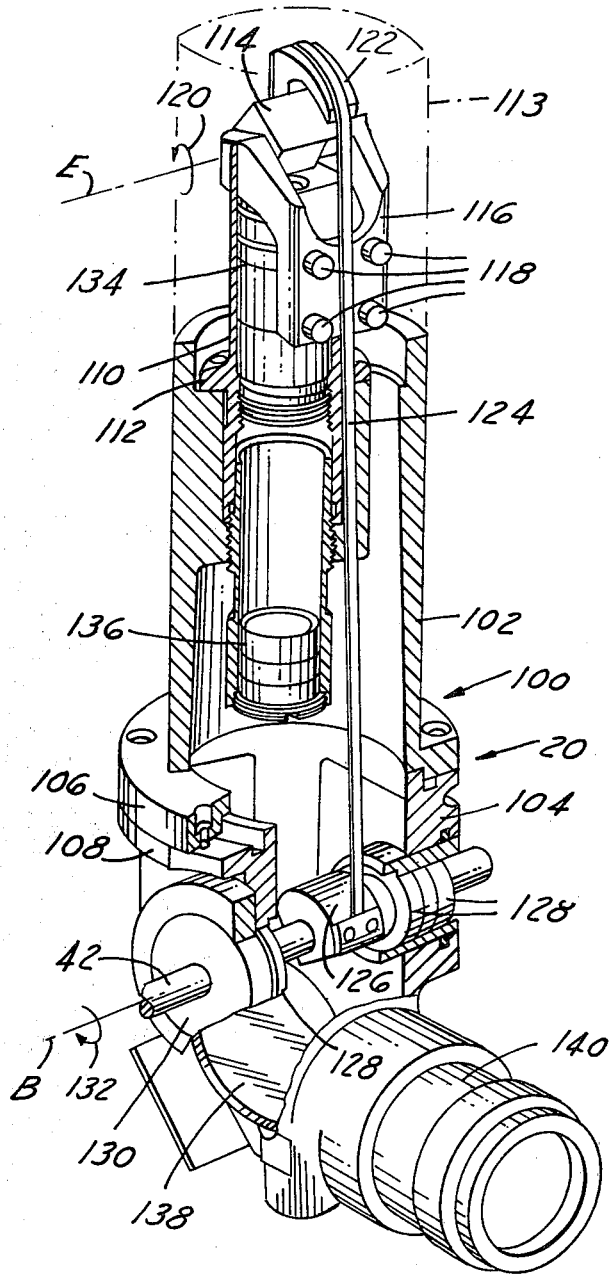
FIG. 5 is a perspective view taken in section of one type of gun sight with which the positioning mechanism can be utilized.

FIG. 5 illustrates the construction of the periscope gun sight 20 which is one type of gun sight with which the positioning mechanism of the present invention is adapted to be utilized. Sight 20 includes a housing 100 having an upper member 102 that is adapted to project upwardly through a gun turret and a lower member 104 that is received within the turret gunner compartment. Flanges 106 and 108 of the housing members 102 and 104, respectively, are secured to each other by the nut and bolt connections to maintain the housing members in the engaged position shown. An upper housing extension 110 has a flange 112 that is secured to the upper housing member 102 by suitable threaded fasteners (not shown) and is normally enclosed within a cover 113 illustrated by phantom line representation. A glass covered opening of the cover which is not shown is aligned with a prism 114 that is mounted by a support 116 secured to the housing extension 110 by threaded fasteners 118.

Prism 114 of the gun sight shown in FIG. 5 is aligned on the gun turret with the direction of gun barrel orientation and is pivotally mounted on the support 116 about a horizontal axis E which is located in a parallel relationship with the axis of the gun trunnion shaft. A suitable biasing spring (not shown) biases the prism 114 in the direction shown by arrow 120 which corresponds to a downwardly direction of prism inclination with respect to the horizontal. A strap connector member 122 is bonded or otherwise suitably secured to the prism 114 for pivotal movement therewith and secures the upper end of a generally flexible strap 124 whose engagement with the connector member is at a partially circular surface generated about the axis E. The lower end of strap 124 is secured to a connector member 126 fixed on the sight positioning shaft 42 and is engaged with a partially circular surface of this connector member generated about the axis B of shaft movement. Bearings 128 support the shaft 42 for movement about axis B and a clock-like biasing spring within a housing 130 biases the shaft in the direction shown by arrow 132 so that the strap 124 is tensioned in cooperation with the bias provided on the prism 114.

An image received by the prism 114 through the opening in cover 113 is projected downwardly through magnifying units 134 and 136 supported by the housing extension 112 and is reflected by a mirror 138 to an eye piece 140 that has suitable reticle markings. Pivotal movement of the shaft 42 by the positioning mechanism in the manner previously described pivotally positions the prism 114 so that the image received and transferred to the eye piece 140 corresponds to an aligned relationship with the gun barrel. The partially circular surfaces of the connector members 122 and 126 over which the ends of the strap 124 are engaged insure that the shaft movement is accompanied by corresponding movement of the prism.

A distance indicator 142 of the gun sight positioning mechanism is best illustrated in FIGS. 3 and 4 and includes a somewhat unsymmetrical pie-shaped member 144 that is secured by welds 146 to the coupling member 48 that secures the link 46 to the trunnion shaft 32. A partially circular surface 148 of the member 144 has marking indications that correspond to the approximate gun firing distance in hundredths of meters and is located adjacent an edge 150 of an indicator member 152 that is fixedly secured to the gun sight 22 by bolts 154. Clockwise pivoting of the member 144 locates the edge 150 adjacent higher markings on the surface 148 in correspondence with the higher inclination of the gun supported by the trunnion shaft 32. Likewise, counterclockwise movement of the member 154 aligns the lower markings with the edge 150 in correspondence with the lower inclination of the gun. An approximate indication of the gun firing distance is thus achieved by use of the indicator 142.

While the best mode for carrying out the invention has herein been described, those familiar with the art to which this invention relates will recognize various alternative designs and embodiments for practicing the invention as defined by the following claims.

What is claimed is:

1. A gun sight positioning mechanism comprising a parallelogram linkage for moving a gun sight positioning shaft angularly with a gun trunnion shaft such that the gun sight tracks with a gun supported on the trunnion shaft; and a slip clutch that connects the linkage to one of the shafts so as to allow the positioning shaft of the sight to be pivoted independently of the trunnion shaft whereby the sight can be aimed downwardly at the target area while the gun remains aimed upwardly along the projectile path.

2. A mechanism as in claim 1 wherein the slip clutch includes a stop means that allows the sight to be moved upwardly back into alignment with the gun after viewing the impact.

3. A mechanism as in claims 1 or 2 wherein the slip clutch connects the linkage with the positioning shaft of the gun sight.

4. A mechanism as in claim 1 wherein the linkage includes a first link having a connection for support thereof on the trunnion shaft, a second link connected to the gun sight positioning shaft by the slip clutch, and a connecting link that extends between the first and second links.

5. A mechanism as in claim 4 wherein the connecting link includes means for adjusting the length thereof between the first and second links.

6. A mechanism as in claims 4 and 5 wherein the slip clutch includes a brake member that engages the second link to provide coupling thereof to the positioning shaft of the gun sight, and a spring washer that biases the brake member against the second link.

7. A mechanism as in claim 6 wherein the second link includes a stop that limits pivotal movement of the gun sight positioning shaft with respect thereto in one direction.

8. A mechanism as in claim 7 further including a handle that pivots the gun sight positioning shaft and is engageable with the stop to limit the pivoting thereof with respect to the second link.

9. A mechanism as in claim 8 wherein the slip clutch includes a mount which has a flanged end that is secured to the gun sight positioning shaft and a distal end on which the handle is secured.

10. A mechanism as in claim 9 wherein the slip clutch includes a retainer on the distal end of the mount for biasing the spring washer so as to engage the brake member with the second link which is thereby engaged with the flanged end of the mount.

11. A mechanism as in claim 4 wherein the connection for supporting the first link includes an annular member for receiving the trunnion shaft in a fixed relationship thereon.

12. A gun sight positioning mechanism comprising a linkage including a first link having a connection for providing support thereof on a trunnion shaft so as to be pivotal with a gun supported by the trunnion shaft for movement about a first axis; a second link having a connection for providing support thereof on a gun sight positioning shaft so as to be pivotal about a second axis parallel to the first axis; a connecting link that extends between the first and second links along a direction parallel to a line between the first and second axes; said connecting link having a length equal to the spacing between the first and second axes such that the positioning shaft of the sight is moved angularly with the trunnion shaft; and one of said connections including a slip clutch for allowing the positioning shaft of the gun sight to be pivotal independently of the trunnion shaft so that the gun sight can be aimed downwardly at the target area while the gun remains aimed upwardly along the projectile path.

13. A gun sight positioning mechanism comprising a linkage including a first link having a connection for providing support thereof on a gun trunnion shaft so as to be pivotal with a gun supported by the trunnion shaft for movement about a first axis; a second link having a connection for providing support thereof on a gun sight positioning shaft so as to be pivotal about a second axis parallel to the first axis; a connecting link that extends between the first and second links along a direction parallel to a line between the first and second axes; said connecting link having a length equal to the spacing between the first and second axes such that the positioning shaft of the sight is moved angularly with the gun trunnion shaft; and the connection of the second link including a slip clutch for allowing the positioning shaft of the gun sight to be pivotal independently of the trunnion shaft so that the gun sight can be aimed downwardly at the target area while the gun remains aimed upwardly along the projectile path.

14. A gun sight positioning mechanism comprising a linkage including a first link having a connection for providing securement thereof on a gun trunnion shaft so as to be pivotal with the gun about a first axis: a second link having a connection for providing support thereof on a gun sight positioning shaft so as to be pivotal about a second axis parallel to the first axis; a connecting link that extends between the first and second links along a direction parallel to a line between the first and second axes; said connecting link having means for adjusting the length thereof so as to be equal to the spacing between the first and second axes such that the positioning shaft of the sight is moved angularly with the gun trunnion shaft; the connection of the second link including a slip clutch including a mount having a flanged end that is secured to the gun sight positioning shaft; the second link being supported by the mount in engagement with the flanged end thereof; the slip clutch including a brake member and a spring washer on the mount with the brake member biased against the second link by the spring washer so as to thereby bias the second link against the flanged end of the mount; and a handle for pivoting the mount so as to pivot the positioning shaft of the gun sight while the slip clutch allows the second link to remain stationary whereby the gun sight can be aimed downwardly at the target area while the gun remains aimed upwardly along the projectile path.

15. A gun sight positioning mechanism comprising a linkage including a first link having a connection for providing securement thereof on a gun trunnion shaft so as to be pivotal with the gun about a first axis; a second link having a connection for providing support thereof on a gun sight positioning shaft so as to be pivotal about a second axis parallel to the first axis; a connecting link that extends between the first and second links along a direction parallel to a line between the first and second axes; said connecting link having means for adjusting the length thereof so as to be equal to the spacing between the first and second axes such that the positioning shaft of the sight is moved angularly with the gun trunnion shaft; the connection of the second link including a slip clutch including a mount having a flanged end that is secured to the gun sight positioning shaft; the second link being supported by the mount in engagement with the flanged end thereof; the slip clutch including a brake member and a spring washer on the mount with the brake member biased against the second link by the spring washer so as to thereby bias the second link against the flanged end of the mount; a handle for pivoting the mount on one direction so as to pivot the positioning shaft of the gun sight while the slip clutch allows the second link to remain stationary whereby the gun sight can be aimed downwardly at the target area while the gun remains aimed upwardly along the projectile path; and a stop that limits pivoting of the mount with respect to the second link in the other direction so that the gun sight positioning shaft can be pivoted by the handle to aim the sight upwardly into alignment with the gun after viewing the impact.

16. A gun sight positioning mechanism comprising a parallelogram linkage for moving a gun sight positioning shaft angularly with a gun trunnion shaft such that the gun sight tracks with a gun supported on the trunnion shaft; and a slip clutch that connects the linkage to one of the shafts so as to allow the sight shaft to be pivoted in one direction independently of the trunnion shaft whereby the sight can be aimed at the target area while the gun remains aimed along the projectile path; and stop means for limiting pivoting of the gun sight shaft in the other direction independently of the trunnion shaft so that the sight can be aimed upwardly in alignment with the gun after viewing the impact.

* * * * *